US007571629B2

(12) United States Patent
Seliber

(10) Patent No.: US 7,571,629 B2
(45) Date of Patent: Aug. 11, 2009

(54) POSITIONAL MULTIPLEX KEYWAY SYSTEM

(75) Inventor: Lloyd Seliber, Lititz, PA (US)

(73) Assignee: Dorma Door Controls, Inc., Reamstown, PA (US)

( * ) Notice: Subject to any disclaimer, the term of this patent is extended or adjusted under 35 U.S.C. 154(b) by 0 days.

(21) Appl. No.: 11/502,880

(22) Filed: Aug. 11, 2006

(65) Prior Publication Data

US 2007/0017264 A1 Jan. 25, 2007

Related U.S. Application Data

(60) Provisional application No. 60/707,507, filed on Aug. 11, 2005.

(51) Int. Cl.
*E05B 35/08* (2006.01)

(52) U.S. Cl. ..... 70/337; 70/339; 70/340; 70/409

(58) Field of Classification Search ..... 70/337, 70/339–343, 409, 493
See application file for complete search history.

(56) References Cited

U.S. PATENT DOCUMENTS 1,850,586 A * 3/1932 Heyer ..... 70/338
2,197,673 A * 4/1940 Ricardo ..... 70/395
4,107,963 A * 8/1978 Yorio et al. ..... 70/337
4,440,009 A * 4/1984 Smith ..... 70/385
4,912,953 A * 4/1990 Wobig ..... 70/383
RE35,518 E * 5/1997 Sussina ..... 70/369
5,943,890 A * 8/1999 Field et al. ..... 70/409
7,073,360 B2 * 7/2006 Johansson et al. ..... 70/337

* cited by examiner

*Primary Examiner*—Peter M Cuomo
*Assistant Examiner*—Christopher Boswell
(74) *Attorney, Agent, or Firm*—Cohen Pontani Lieberman & Pavane LLP

(57) ABSTRACT

A method and apparatus for extending an existing simplex or multiplex lock-and-key system that includes a family of first keys each having a first profile and of a corresponding plurality of first locks each operable by a first key and each having a first keyway configured for accepting the first key profile. Second keys of a new family are defined with a core section corresponding to the first key profile and a narrowed projection extending from the bottom of the core section. Corresponding second locks have a second keyway profile defined as the compliment of the second key profile, thus including a complimentary core section and a foot recess extending from the bottom of the second keyway core section. The second locks accept a second key positioned at the second keyway baseline to normally lift the lock pin stacks and operate the second lock. The second locks also accept the first keys but the first keys cannot enter the narrowed foot recess of the second keyway and are accordingly elevated in the second keyway above the keyway baseline, and are therefore unable to normally lift the lock pin stacks to operate the second lock.

13 Claims, 7 Drawing Sheets

PRIOR ART

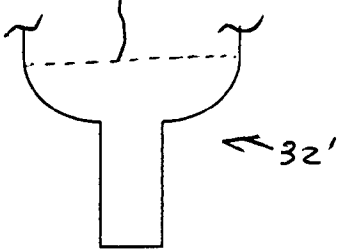
Figure 10A
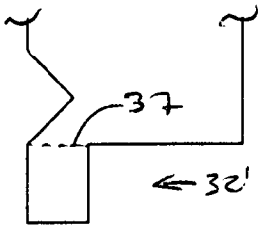
Figure 10B
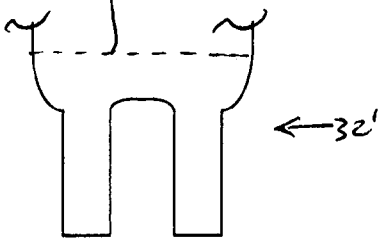
Figure 10C
Figure 10D
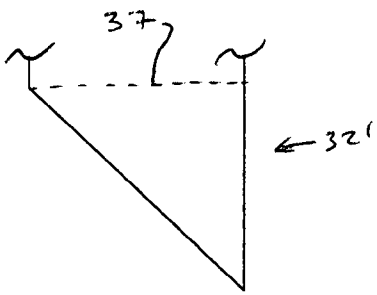
Figure 10E
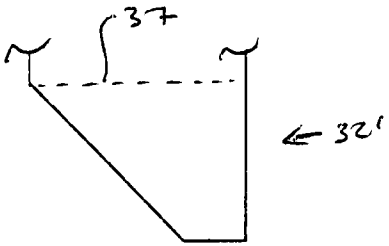
Figure 10F

POSITIONAL MULTIPLEX KEYWAY SYSTEM

RELATED APPLICATION

This application claims priority from U.S. Provisional Patent Application Ser. No. 60/707,507, filed Aug. 11, 2005, the entire disclosure of which is expressly incorporated by reference herein.

BACKGROUND OF THE INVENTION

1. Field of the Invention

The present invention broadly relates to multiplex keyway systems for keyed mechanical locks and, more particularly, to systems and methods for creating extended families of keyways and associated keys which share a common master key for operating any lock having one of the keyways.

2. Description of the Related Art

Mechanical locks are currently the most common mechanisms providing access control for doors and other limited-availability spaces or locations, and are in widespread use to guard the entrances to the vast majority of personal residences, commercial offices, factories and manufacturing plants, educational institutions, hotel rooms and a host of other sites, as well as to protect or secure readily movable or transportable articles such as bicycles, land, sea and air vehicles, tool and other article holders, and numerous other objects from use or removal or theft by unauthorized or unintended individuals. One of the most popular lock designs in extensive practical use is the so-called pin tumbler lock, parts of which are variously shown by way of example in FIGS. 1 and 3. The lock typically comprises a rotatable cylinder tube 102, called the plug, which is linked to the underlying locking mechanism. Disposed about the circumference of the plug is a shell (not shown), which in a fixed-use application is normally nonremovably secured to a door or housing. Relative rotation of plug 102 within the shell in response to a torque generated by user-manipulation of a key 104 (FIG. 2) that is inserted within the keyway of plug 102 (see FIG. 3) operates the locking mechanism. In the locked or nonoperating state of the lock such rotation of plug 102 is prevented by a set of longitudinally displaceable, spring-loaded pin stacks 106 that protrude from a series of bores defined in the top of plug 102 (FIG. 1) and extend into corresponding bores defined in the shell, with a compression spring 108 disposed within each shell bore urging each respective pin stack toward the axis of plug 102. Each pin stack 106, which is typically formed of multiple predetermined lengths of pins, thereby defines one or more pin stack discontinuities or cuts or breaks or separations 110 between the individual pins, along and generally perpendicular to the length of that stack. Completing the lock is a tail piece (not shown) connected to the plug and configured to transmit a torque, resulting from relative rotation of plug 102 within the shell, in either the unlocking (i.e. opening) or locking direction.

With no key in the lock (FIG. 1), the respective compression spring 108 presses each pin stack 106 into its rest position within the plug and shell, with each of the pin stack separations or discontinuities 110 disposed within the plug. When, however, a cut or bitted key 104 is inserted into the plug, as shown in FIG. 3, through a lock keyway having a profile complimentary to that of the key, the pin stacks 106 are variously raised within the plug and shell by the respective key bittings. If the key has been cut to open that particular lock—i.e. the key bittings correspond to the pin stack separation heights or locations—then the fully-inserted key 104 will lift each pin stack so that one of its discontinuities is aligned at a border 112, called the shear line, which is located between the plug and the circumferential shell. The plug 102 can then freely rotate—in response to a turning torque applied to the key by a user—relative to the shell to thereby unlock or relock the door or other location or article. On the other hand, the plug 102 will be prevented from rotating relative to the shell if any single pin stack either is insufficiently lifted by the corresponding key bitting so that the pin stack separation 110 remains below the shear line (i.e. within the plug) or is lifted too far by the corresponding key bitting so that the pin stack separation is advanced above the shear line 112 (i.e. into the shell). The series of cut depths of a key 104 under the plural respective pin stack positions—i.e. the bitting of the key—defines the combination or code necessary to operate a particular lock; a key that is bitted to the wrong depth in even a single pin stack position will not operate that lock. Typical residential and commercial locks generally have five or six pin stacks 106, or much less commonly four or seven stacks, with from four to ten distinct cut depths generally used on each.

The available number of combinations based on the topology of any specific key are seemingly limited only by attainable manufacturing tolerances. In practice, however, there are a number of limiting factors. The angle between adjacent key cuts must be controlled to assure the smooth insertion into and extraction of the key from a lock keyway. Keys with very deep cuts are, moreover, prone to breakage, deformation, etc. and are therefore generally avoided Perhaps the most serious limitation to the number of available combinations is that caused by master keying, i.e. creating an arrangement or grouping of families having two or more levels of keying. Master keying is commonly implemented by providing multiple sepaations or discontinuities in a pin stack; one separation is used for operating the lock in response to a change or low level key—i.e. a key specially bitted to operate for example only that lock—and the other for a master or top level key that is bitted to operate all or a predetermined plurality of differently-configured locks, for example in multiple families of a hierarchical multiplex grouping of keyways.

There is for a number of reasons a common need to increase or extend the number of distinct keys, each for operating a corresponding different lock cylinder, that can be used on the same project, such for example as a hotel, school, manufacturing facility or office complex. A single keyway profile, and the maximum plurality of differently-bitted keys having a complementary profile that can be utilized in a master keyed arrangement, may be insufficient to fully populate all of the doorways or other entry or access openings needed in a single facility or location. One way in which to extend the number of available distinct key combinations is through the use of multiplex keyways which are constructed in hierarchies with a top-level keyway and low-level keyways all configured with blocking elements that prevent the incorrect keys from entering unintended keyways. The principle of operation of such a multiplex keyway system is the blocking of one low-level key profile or section from entering a different low-level keyway, while allowing a master key to both enter and unlock all of the low-level locks.

The simplest prior art multiplex hierarchy is illustrated in FIG. 4; low-level keyways 10 and 20 are configured to accommodate the entry of keys $\mathbf{10}_1 \ldots \mathbf{10}n$ and $\mathbf{20}_1 \ldots \mathbf{20}_n$, respectively. All keys $\mathbf{20}_n$ are blocked from entering keyway 10, and all keys $\mathbf{10}_n$ are blocked from and therefore unable to enter keyway 20. This arrangement allows the same key combinations (i.e. bitting combinations) to be reused for keys to access each of the low-level keyways 10, 20 without unwanted key interchange. If the locks are master keyed, then a master key 12 is configured so that it can enter both the low-level keyway 10 and the low-level keyway 20 and operate all of the locks of both.

If it is then desired to increase the number of available combinations of keys, a new keyblank is produced with a profile that is defined by modifying the profile of the master key 12 to, for example, increase the size of one or more surface features of the master key profile. The new system thus has a new keyway 20'—with a profile complementary to the new keyblank—which will accept the new keys $\mathbf{20'}_1 \ldots \mathbf{20'}_n$ but which blocks entry of the old keys $\mathbf{10}_n$ and $\mathbf{20}_n$. The old keyways 10 and 20 correspondingly block the new keys $\mathbf{20'}_1 \ldots \mathbf{20'}_n$. And all of the keyways 10, 20 and 20' will accept the master key 12. Moreover, the extended multiplex hierarchy now has fifty percent more key combinations available than the original multiplex hierarchy that included only the keyways 10 and 20.

In practice, lock makers often create multiplex families of more, often many more, than two base-level key sections; indeed, some families have 80 or more sections. However, at some point any multiplex hierarchy reaches a practical limit of the number of families that can be added to further extend the number of available unique lock-and key combinations within the hierarchy using currently-practiced procedures, and there accordingly remains an unsatisfied need for ways to further extend such hierarchies to additional key-keyway combinations.

Another technique currently used for increasing the number of available key combinations involves extending a simplex keyway into a family of multiplex keyways. In a simplex keyway system, only a single independent key can enter the keyway and operate a lock configured with the proper bitting combination. In this technique, a blank for the key configured to operate the existing or "old" simplex keyway is double milled to produce a master key capable of entering the new keyway(s) and operating the associated locks. This, however, often leads to "weak" master keys, and the double milled key may or may not fit into both the old and new keyways at the same position, rendering lock operation with the key unreliable.

A need therefore exists for a positional multiplex keyway system and method that can extend a simplex keyway into multiplex families, and extend ordinary multiplex families into larger multiplex families.

SUMMARY OF THE INVENTION

These and other needs are met by the inventive positional multiplex system and methods of extending current simplex and multiplex hierarchies. In accordance with the present invention, change keys constituting one of multiple low-level key sections can enter a keyway of another base-level key section, but are positioned in the keyway of the other base-level section so that they cannot operate the associated lock. Thus, in contrast to the heretofore known art, the inventive system does not seek to create keyway hierarchies by blocking one base-level key section from entering another base-level keyway; rather, a base-level key is able to enter a different base-level keyway but is elevated or heightwise displaced within the different base-level keyway, thereby rendering it incapable of operating the lock because the lock pin stack separations are lifted by the key beyond the shear line.

Thus, in extending an existing simplex or multiplex system, a new low-level or base keyway is provided that allows a group of "old" change keys for an existing keyway to enter and fully advance into a plug having the new keyway. The new keyway is configured and shaped and dimensioned, however, so that the entered "old" key cannot lift the pin stacks to the correct positions to operate the associated lock.

The new keyway includes, in accordance with the invention, a narrowed foot at the bottom of the keyway which prevents a key not configured for that keyway but otherwise able to enter the keyway from fully entering the foot section of the keyway—i.e. from being positioned on the baseline of the keyway profile. In accordance with an embodiment of the invention, the keyway foot has a width which is, at least in part, smaller than the width of the bottom or base of an "old" or pre-existing key profile so that, even though the "old" key is able to enter the keyway, the key sits in the keyway in a raised position above the bottom or baseline of the keyway. Accordingly, when the "old" key enters the plug, the lifted pin stack separations will be positioned above the shear line, which will thereby prevent the key from rotating the plug relative to the sleeve and thus operating the lock. A key specially configured to enter the new keyway of this embodiment and operate the associated lock, on the other hand, has the same profile as the "old" key which can enter the new keyway but additionally includes a projection or like reduced-width structural element that extends downward (i.e. away from the bitting surface of the key) from that portion comprising the "old" key profile. This "new" key is thus configured so that, when inserted into the keyway, its reduced-width projection is received within the narrowed foot of the new keyway, positioning the bottom of the key on the keyway baseline and thereby properly positioning its bittings to lift the pin stack separations into correct alignment with the shear line for operation of the lock.

In accordance with an embodiment of the inventive method, in a lock-and-key system comprising a plurality of differently-bitted first keys each having a first profile and a corresponding plurality of first locks each operable by a corresponding one of the first keys and each having a first keyway configured to accept the first key profile for entry of the first keys into the first keyways, wherein the first key profile comprises a first key section that extends between a base having a width and a top surface and a predetermined contour defined by a groove along the first key section at a predetermined spacing above the first key base, and wherein the first keyway has a profile complementary to the first key profile and comprises a blocking element disposed for complementary mating engagement with the first key groove when the first key is disposed in the first keyway, a method of providing a plurality of second locks each having a second keyway and a plurality of differently-bitted second keys each having a second profile and each bitted for operating a corresponding one of the second locks, the second keyway being configured so that each of the first locks and each of the second locks can be entered through the respective first and second keyways by a single master key for operating all of the first and second locks, the method comprising the steps of configuring the second key profile as comprising a core section configured as the first key profile and a narrowed projection extending downwardly from the first key profile base of the core section and having a width less than the first key base width such that the second key cannot enter the first keyway of the first locks; and configuring the second keyway for receipt of the second key profile and including a foot for accommodating the second key projection and a blocking element for complementary mating engagement with a groove defined in the second key core section when the second key enters the second keyway and for complementary mating engagement with the first key groove when the first key enters the second keyway so that said first key is receivable in the second keyway.

In accordance with another embodiment of the inventive method, in a lock-and-key system comprising a plurality of differently-bitted first keys each having a first profile and a corresponding plurality of first locks each operable by a corresponding one of said first keys and each having a first keyway configured to accept the first key profile for entry of the first keys into the first keyways, wherein the first key profile comprises a first key section that extends between a base having a width and a top surface and a predetermined contour defined by a groove along the first key section at a predetermined spacing above the first key base, and wherein the first keyway has a profile complementary to the first key profile and comprises a blocking element disposed for complementary mating engagement with the first key groove when the first key is disposed in the first keyway, a method of providing a plurality of second locks each having a second keyway for use with a plurality of differently-bitted second keys each having a second profile complimentary to a profile of the second keyway and each bitted for operating a corresponding one of the second locks, the second keyway being configured so that each of the first locks and each of the second locks can be entered through the respective first and second keyways by a single master key for operating all of said first and second locks, the method comprising configuring the second profile of the second keyway as comprising a core section configured complimentary to the first key profile and a narrowed foot recess extending downwardly from the core section to a baseline of the second keyway, the narrowed foot having a width less than the first key base width, for receipt by the second keyway of the complimentary second key profile and for receipt by the second keyway of the first key in a position in which the first key enters the complimentary core section of the second keyway and is unable to enter the narrowed foot of the second keyway and is thereby elevated in the second keyway above the second keyway baseline to prevent operation of the second lock by the first key.

In accordance with an embodiment of the inventive system, in a lock-and-key system that includes a first lock-and-key family comprising a plurality of differently-bitted first keys each having a first profile and a corresponding plurality of first locks each operable by a corresponding one of the first keys and each having a first keyway configured to accept the first key profile for entry of the first keys into the first keyways, wherein the first key profile comprises a first key section that extends between a base having a width and a top surface and a predetermined contour defined by a groove along the first key section at a predetermined spacing above the first key base, and wherein the first keyway has a profile complementary to the first key profile and comprises a blocking element disposed for complementary mating engagement with the first key groove when the first key is disposed in the first keyway, the improvement comprising a second lock-and-key family, the second family comprising a plurality of second locks each having a second keyway; and a plurality of differently-bitted second keys each having a second profile and each bitted for operating a corresponding one of said second locks; wherein the second keyway is configured so that each of the first locks and each of the second locks can be entered through the respective first and second keyways by a single master key for operating all of the first and second locks; wherein the second key profile comprises a core section configured as the first key profile and a narrowed projection extending downwardly from the first key profile base of the core section and having a width less than the first key base width such that the second key cannot enter the first keyway of the first locks; and wherein the second keyway is configured for receipt of the second key profile and includes a foot for accommodating the second key projection and a blocking element for complementary mating engagement with a groove defined in the second key core section when the second key enters the second keyway and for complementary mating engagement with the first key groove when the first key enters the second keyway so that said first key is receivable in the second keyway.

Other objects and features of the present invention will become apparent from the following detailed description considered in conjunction with the accompanying drawings, in which like elements are denoted by like reference numerals throughout the various Figures. It is to be understood, however, that the drawings are designed solely for purposes of illustration, and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWINGS

In the drawings:

FIGS. 10A to 10F are diagrammatic views, partly broken away, of alternate forms by way of illustrative example of a projection defined on a new key configured in accordance with the invention.

DETAILED DESCRIPTION OF THE CURRENTLY PREFERRED EMBODIMENTS

Figure 1:
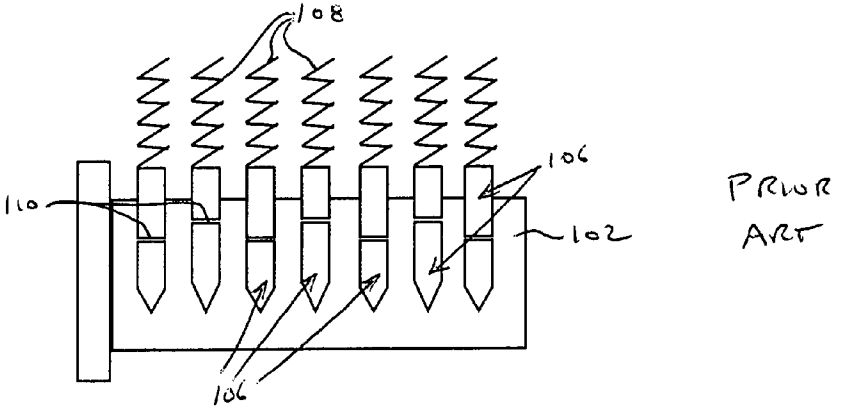
FIG. 1 is a cross-sectional side view of a prior art lock cylinder.
Figure 2:
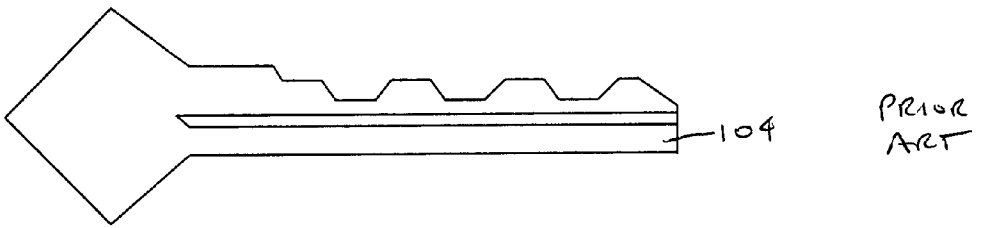
FIG. 2 is a side view of a prior art key.
Figure 3:
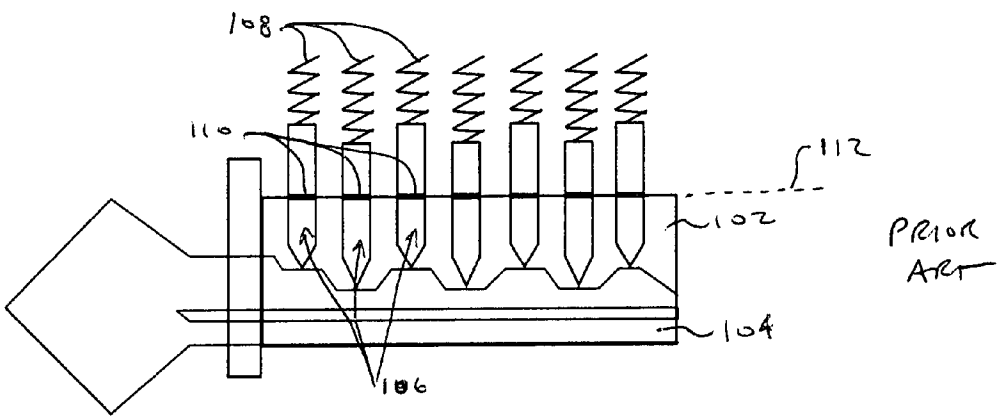
FIG. 3 is a cross-sectional side view of a prior art lock cylinder with an inserted key.
Figure 5:
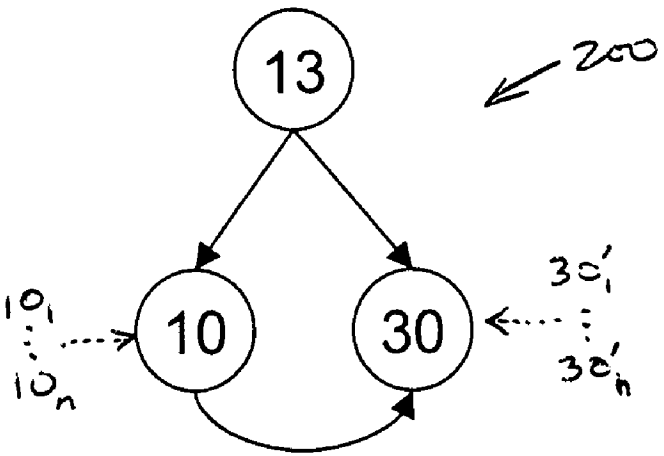
FIG. 5 is a diagrammatic view of a multiplex keyway system in accordance with the present invention.
Figure 4:
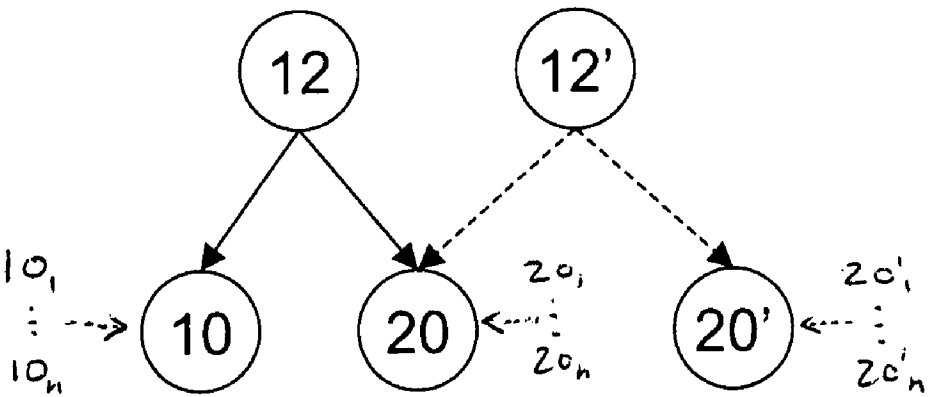
FIG. 4 is a schematic representation of a prior art multiplex keyway system.

A lock and key system 200 configured in accordance with the invention and shown and described to facilitate an understanding and appreciation of the invention is depicted in FIG. 5. For ease of explanation and illustration, this Figure, and the accompanying description, relates specifically to applying the inventive subject matter to what is initially a simplex system to create a simple multiplex hierarchy. Nevertheless, those skilled in the art will recognize and appreciate that the invention is equally and, indeed, even more advantageously applicable for use with existing multiplex hierarchies to extend such hierarchies and thereby notably increase the number of unique lock-and-key families available for use in such existing multiplex hierarchies. There is accordingly no intention to limit the scope of the invention to use with either simplex or multiplex systems, or to particular types or configurations of simplex or multiplex systems, as will be apparent to those of ordinary skill.

In any event, the system 200 of FIG. 5 includes a plurality of existing or "old" series keys $\mathbf{10}_1 \ldots \mathbf{10}_n$ which are configured to enter an existing or "old" keyway 10 and variously bitted to operate respective locks associated therewith. In accordance with the invention, a new keyway 30 is configured so that the "old" keys $\mathbf{10}_n$ are able to enter the new keyway 30 but—although the keys $\mathbf{10}_n$ are bitted with the same combinations with which the new keyway locks 30 are provided—the keys $\mathbf{10}_n$ are unable to operate the associated locks equipped with the new keyway 30 into which the keys $\mathbf{10}_n$ have been inserted. Thus, the "old" keys $\mathbf{10}_n$ can enter the new keyway 30, new keys $\mathbf{30}_1 \ldots \mathbf{30'}_n$ which are bitted or cut to enter and operate the locks of the new keyway 30 are blocked from entering the "old" keyway 10, and a master key 13 is configured to enter both the old and new keyways 10 and 30.

Figure 6C:
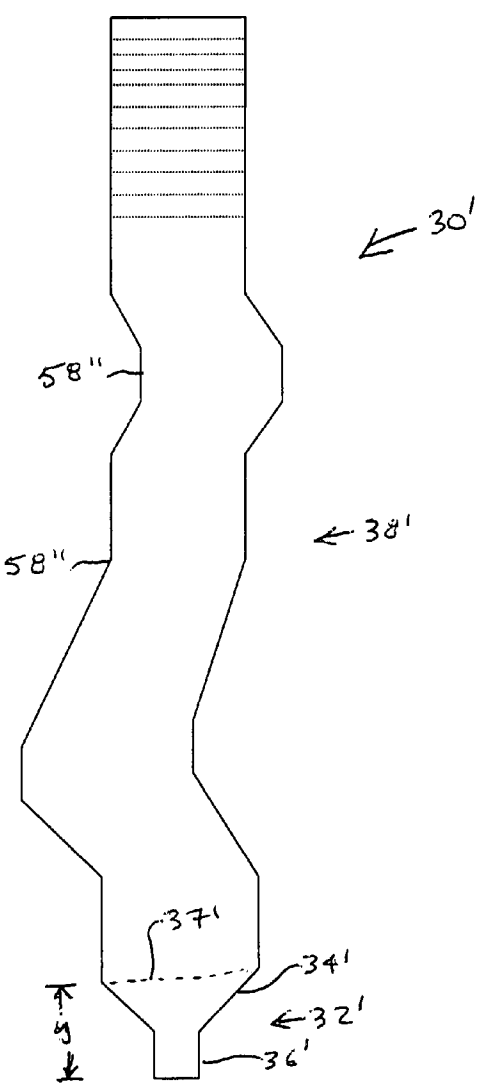
FIG. 6C is a diagrammatic view of a new key profile configured in accordance with the invention for use with the keyway of FIG. 6B.
Figure 6B:
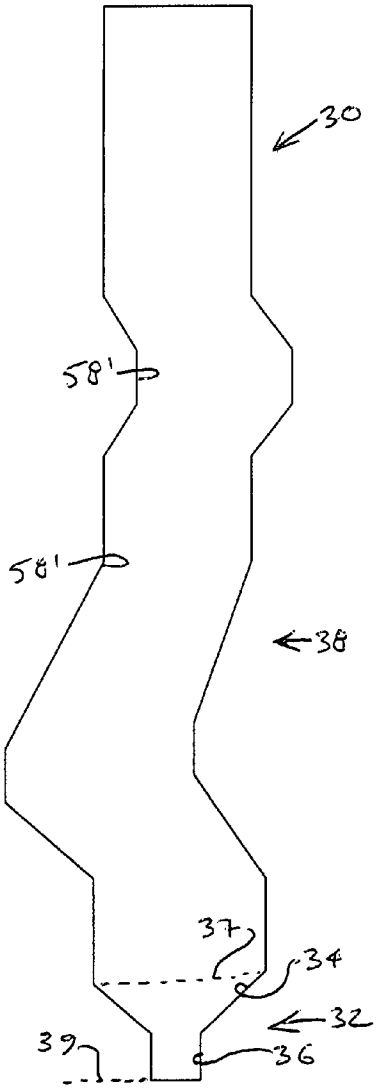
FIG. 6B is a diagrammatic view of a new keyway profile configured in accordance with the invention.
Figure 6A:
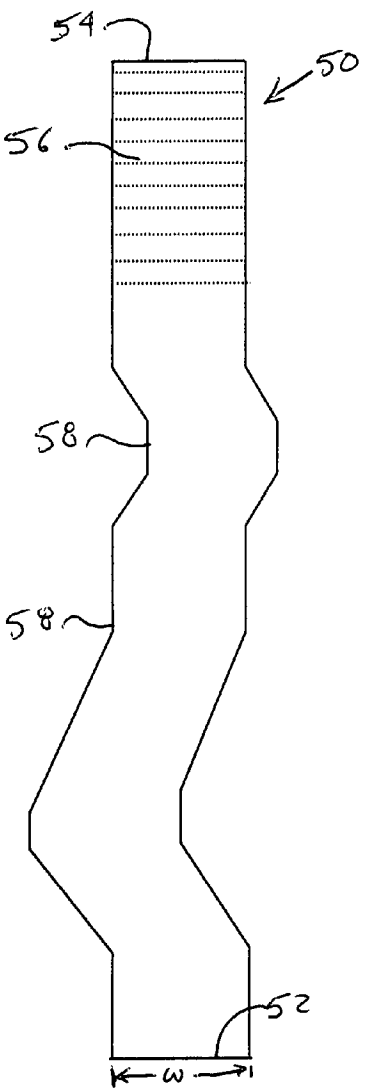
FIG. 6A is a diagrammatic view an "old" change key profile.

Shown in respective FIGS. 6A and 6B are the distal end or profile of a key blank 50 of an "old" key $\mathbf{10}_n$ and the profile of new keyway 30 that is configured in accordance with a preferred embodiment of the present invention. The term key blank is used herein in its normal sense to denote a component manufactured to the proper size and configuration for entering into the keyway of a specific lock, but that has not yet been provided with bitting to define the combination necessary to operate the lock. The profile of a key blank, and of a cut key, typically has a contour that includes one or more grooves, lands and/or other surface features, structures and/or formations—collectively referred to herein as grooves—that extend longitudinally along the elongated blade, and an associated keyway for receiving the key has a typically complementary profile in which blocking elements such as grooves, lands and/or other surface features, structures and/or formations—collectively referred to herein as blocking elements—are defined for complementary mating with the key profile grooves to permit the proper key to enter the keyway. Thus, for example, a key or key blank profile may include a groove defined on the blade at a predetermined spacing above the bottom or base of the key, and a keyway intended to accommodate that key or key blank will typically include a blocking element at a corresponding location along its profile for complementary mating engagement with the key groove, the blocking element thereby generally preventing entry into the keyway of a key blade which lacks a groove at the corresponding location of its blocking element. The key or key blank, and a keyway constructed for that key profile, are configured in a complimentary fashion so that each has substantially the same width—i.e. with correspondingly contoured and sized, complementary profiles—along their respective vertical (in the Figures) lengths, although it will be appreciated that, as a practical matter, the width of the keyway must be slightly greater than the width of the key at any given location along their lengths to permit the key to freely enter the keyway; thus references herein to a particular width of key or keyway profiles or portions thereof are intended to include and accommodate such slight differences as may be necessary for that purpose, including acceptable tolerances. Moreover, unless indicated or required by context, references herein to a key or key blank are generally intended to connote either or both.

In FIG. 6A, the key or key blank 50—i.e. its profile or blade profile—has a height which extends from its bottom or base 52 to a top surface 54 at which is located a bitting region or portion 56 which, for normal use, is cut to that combination of bittings required to operate a particular lock. The key 50 includes one or a plurality of grooves 58 defined at predetermined spacings above the base 52, and the base has a predetermined width w. The particular key profile depicted in FIG. 6A is otherwise generally fanciful and is intended for consideration as merely illustrative to facilitate ease of depiction and explanation.

The "new" keyway 30 has a profile that, in accordance with the invention, includes at its bottom-most region a foot 32 which, in the embodiment shown in FIG. 6B, comprises a frustoconically narrowing portion 34 that tapers to a substantially constant-width recess 36. At the dotted line depicted juncture 37 of the foot 32 and the remainder of the keyway profile—referred to herein as the core portion 38—the keyway profile has a width which is in preferred embodiments substantially the same as, or at least no less than, the width w of the base 52 of key 50; thus, the foot 32 of keyway 30 is—throughout at least the majority of its height—narrower than the width of the base 52 of key 50 so that the base 52 of a key 50 that is inserted into the keyway 30 cannot substantially enter the foot 32 of keyway 30. Instead, a key 50 that has entered keyway 30 has its base 52 located or disposed closely proximate the juncture 37, at the top of the narrowed foot 32, and is thereby vertically elevated within keyway 30 above the bottom or baseline 39 of the keyway.

The keyway foot 32 may have any of numerous alternate shapes or configurations in lieu of that shown in FIG. 6B. It may, for example, be configured to substantially complement the corresponding region of a "new" key 30' which has been prepared specifically for the keyway 30. Alternatively, the foot 32 may be shaped or contoured such that at least one of its sides or sidewalls, or a part or section thereof, is inwardly tapered, as by way of illustration where the foot defines a frustoconical region extending from its top to its bottom. It is generally intended (although not required), in these and any additional configurations of the foot 32 as will become apparent to those of ordinary skill in the art, that the foot advantageously function to guidingly facilitate entry and advance of the corresponding region of a key 30' into and along the foot 32 as a key 30' is inserted into the keyway 30 and, as such, it is preferred that at least a portion of at least one of the sides or sidewalls defining the foot 32 have an inwardly tapered or otherwise angled orientation. In any event, it is essential in accordance with the invention that the foot 32, at least at or closely below the top of foot 32 (i.e. at its juncture 37 with the core portion 38 of the keyway profile), have or taper to a width that is sufficiently less than the width of the base 52 of key blank 50 as to prevent entry of blank 50, or of a key cut from blank 50, from entering foot 32; in other words, so that a key blank or cut key 50 (FIG. 6A) that is inserted into keyway 30 rests substantially at or close to the top of foot 32 to thereby elevate the key above the bottom or baseline 39 of keyway 30.

The core section 38 of keyway 30 is configured to complement the profile of the "old" key blank or key 50. That is, the contours of the key 50, including in particular the locations of all grooves 58, are present in keyway 30 as a complementary keyway profile, including correspondingly shaped and located blocking elements 58'. Thus, in a sense the keyway 30 in this embodiment may be viewed as the combination of a keyway specially configured for and complementary to the profile of the "old" key 50 (i.e. the keyway core section 38) and the narrowed foot 32 which has been unitarily appended to the bottom of core section 38. It is this complimentary correspondence of the profiles of the complement of the "old" key 50 and the core section 38 of the "new" keyway 30 that enable the key 50 to readily enter the keyway 30, even though the base 52 of key 50 is unable to enter the foot 32 which forms the bottom portion of keyway 30. Because, however, the key 50 is unable to enter the keyway foot 32 and therefore rests in keyway 30 at an elevated position above the foot-defining bottom or baseline 39 of the keyway, a key 50 cut with a bitting combination corresponding to the pin stacks combination of a lock using the keyway 30 is nevertheless unable to operate the lock since the pin stack separations are lifted by the elevated "old" key 50 beyond the positions needed to align the pin stack separations with the shear line of the lock.

Shown in FIG. 6C is a "new" key (or key blank) 30' which has, in accordance with the invention, been configured for specific use with the keyway 30. The key 30', like its corresponding keyway 30, may be viewed as unitarily formed of two parts—a core section 38' and a narrowed projection 32' extending from the bottom of the core section. The unitary juncture 37' of the core section 38' and the narrowed projection 32' is depicted by the dotted line in FIG. 6C. The core section 38' of the illustrated embodiment of the key 30' has essentially the same profile as the profile of the "old" key or key blank 50, including correspondingly sized, shaped and located grooves 58" for complementary mating engagement with the blocking elements 58" of keyway 30. In this embodiment of the key 30', the core section 38' is however shorter than the corresponding profile of the "old" key 50 by an amount x, as for example by decreasing the spacing between the bitting region of the key and that portion of the "old" key profile that defines the contours which determine its ability to enter its complementary keyway 10—i.e. that portion of the key profile which includes the grooves 58 and the like. Embodiments of key 30' in which the core section 38' is instead of the same length or height, or of greater height, than the corresponding length or height of the blade profile of the "old" key or key blank 50 are also nevertheless within the scope and contemplation of the invention.

The narrowed projection 32' of key 30' can take on any of numerous forms, primarily as a general matter of design choice. In the embodiment of key 30' depicted in FIG. 6C, projection 32' comprises a narrowing frustoconical part 34' which extends from the junction 37 of the projection 32' and core section 38', and a substantially constant-width, optionally elongated tongue or stub 36' that extends downward (in the Figure) from the bottom of frustoconical part 34'. Thus, in the embodiment shown in FIG. 6C, the projection 32' of key 30' is configured as the compliment of the foot 32 of the keyway 30, as may for example be more readily apparent in FIG. 7B which depicts the superpositioned profiles of a key 30' and a keyway 30. Although the height or length of the projection 32' of key 30' may be selected as a general matter of design choice, in this embodiment of the key 30' its height y is essentially equal to the amount x by which the core section 38' is shorter (i.e. of lesser length) than the corresponding profile of "old" key 55; as a consequence, the total length or height of each of the "old" key 50 and of the new key 30' is in this embodiment substantially the same.

Alternate currently-contemplated configurations of the key 30' projection 32' are shown, by way of illustrative example, in FIGS. 10A to 10F. As should be apparent, the projection 32' can take on virtually any shape or form or combination of shapes or structural features, the essential point being that the projection is sufficiently narrower—i.e. has a smaller width—than the bottom 37' of the core section 38' of the key 30' (which is itself substantially the same as the width of the base 52 of the "old" key 50), so that the projection 32' can freely enter the complimentary or otherwise configured foot 32 of the keyway 30 but the base 52 of "old" key 50 is unable to substantially enter foot 32 and, accordingly, when key 50 is received in keyway 30 it is positioned above the bottom or baseline 39 of keyway 30 so that key 50 cannot operate a lock of keyway 30. Thus, although it is preferred that the projection 32' of a key 30' include at least one side or sidewall portion that is sloped or tapered or angled to guidedly facilitate entry of the key in keyway 30, the projection 32' may instead include an arcuate sidewall portion (such as shown in FIG. 10A) or primarily or solely comprise a substantially constant-width tongue or stub 36' (as shown in FIG. 10B) either centrally or along one edge or otherwise inwardly along the width of the key profile. Projection 32' may alternatively comprise a multiplicity of substantially constant-width tongues 32' (FIGS. 10C and 10D), without or without an accompanying arcuate or angled sidewall or sidewall portion, with the multiple tongues being of the same (FIG. 10C) or different (FIG. 10D) extensions or lengths. Projections 32' formed without a substantially constant-width portion are also contemplated, such for example as those depicted in FIGS. 10E and 10F. All of these alternatives, and others which will be apparent to those of ordinary skill in the art with knowledge of this disclosure, are within the fully intended scope and contemplation of the invention. And, as will be equally apparent, shaping of the profile of the foot 32 of the corresponding keyway 30 to closely complement the selected or implemented configuration of the projection 32' of key 30', or as otherwise desired so long as the projection 32' of key 30' can freely and fully enter the foot 32 of keyway 30, is likewise within the intended scope and contemplation of the invention.

It is as discussed herein an important aspect of the invention that the "old" key 50 can enter the "new" keyway 30, but is relatively displaced within the keyway so that its base 52 is disposed at or closely proximate the top of the keyway foot 32—i.e. the base 52 of key 50 is unable to substantially enter keyway foot 32 because the foot 32 is at least primarily narrower than the key base 52. It will nevertheless be appreciated that practical limitations on the sizing tolerances of key blanks and keyways to assure that keys can freely and easily enter and slide along lock keyways may result in a key 50 in which the base 52 has a width that, while unable to fully, or at least to a significant extent, enter keyway foot 32, may be capable of entering the very topmost portion of foot 32, as for example where foot 32 incorporates a gradually-tapering frustoconical portion or angled sidewall. In such cases, however, a key 50 received in a keyway 30 will nevertheless be disposed in a sufficiently raised or elevated position above the bottom or baseline 39 of the keyway—i.e. above the bottom of the keyway foot 32—so that the key 50 will lift the lock pin stacks too high to enable operation of the lock. Thus, what is important in accordance with the invention is not that the base 52 of "old" key 50 be unable to enter even a topmost fraction of the keyway foot volume but, rather, that the narrowed foot 32 is configured to prevent the key 50 from entering the keyway 30 at the required position or height within the keyway to permit the key 50 to lift the pin stacks to the correct positions to operate the lock. By virtue of the presence of the narrowed or narrowing width foot 32, an "old" key 50 is in accordance with the invention unable to enter the keyway 30 in a way that will locate the key base 52 at the bottom or baseline 39 of the keyway 30.

Figure 7B:
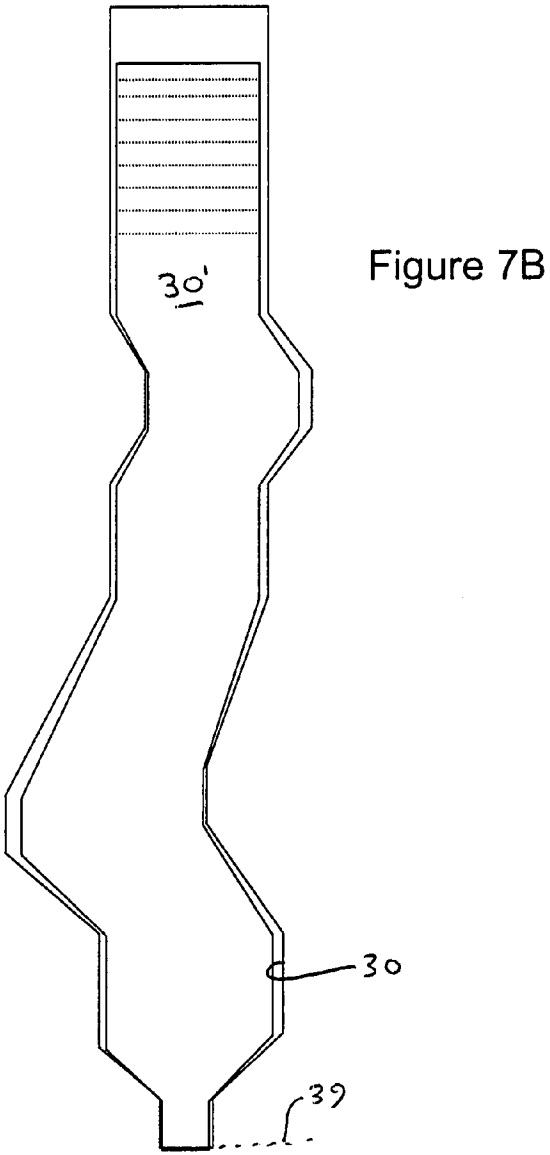
FIG. 7B is a diagrammatic view depicting the position of a new key within a new keyway in accordance with the invention.
Figure 7A:
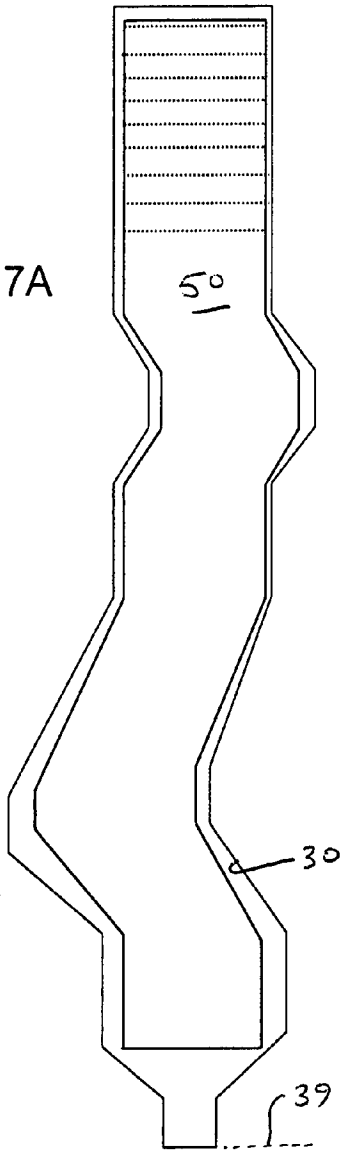
FIG. 7A is a diagrammatic view depicting the position of an "old" change key within a new keyway of the invention.

The way in which an "old" key 50 and a new key 30' are respectively positioned when each enters the new keyway 30 is shown in FIGS. 7A and 7B. As previously described and readily apparent in FIG. 7A, an "old" key 50 can readily enter the core portion 38 of the keyway 30 since that core portion is configured to complement the profile of the key 50. The base 52 of key is positioned proximate the juncture 37 of the foot recess 36 and the core portion 38 of keyway 30, and in any even well above the bottom or baseline 39 of the keyway. Key 50 is accordingly unable to lift the pin stacks of the lock to the correct positions to operate the lock, since the pin stack separations will be lifted beyond the shear line and into the shell, thus preventing rotation of the lock plug within the cylinder.

As seen in FIG. 7B, on the other hand, the profile of the key 30' is the complement of the profile of keyway 30, including the key projection 32' which is configured to enter the keyway foot recess 32 and thereby enable positioning the bottom of key 30' at the bottom or baseline 39 of the keyway. Key 30', bitted with the proper combination for the lock, is thereby able to lift the pin stack separations to the necessary locations aligned with the shear line for selective operation of the lock.

Figures 8A, 8B, 8C:
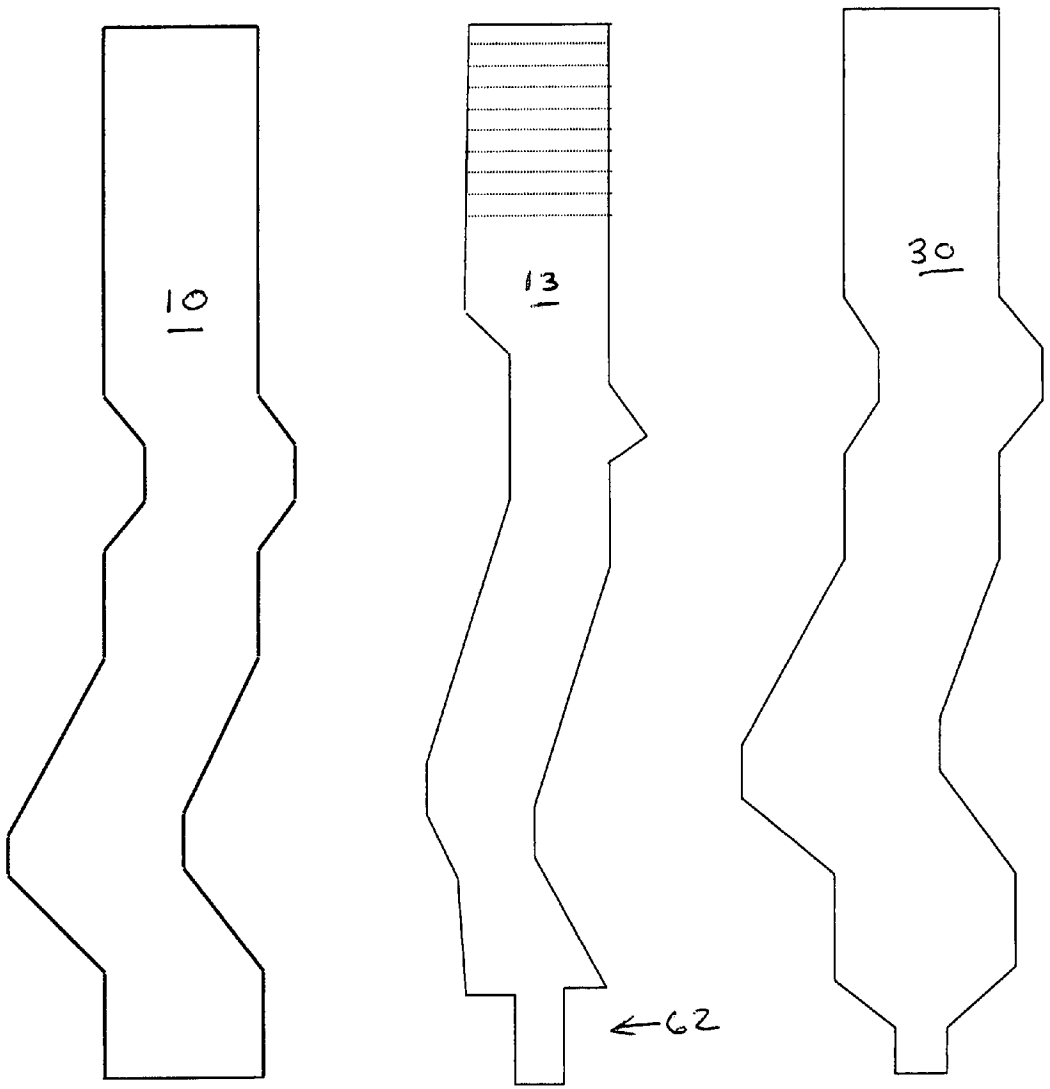
FIG. 8A is a diagrammatic view of an "old" keyway profile.
FIG. 8B is a diagrammatic view of a new master key in accordance with the invention.
FIG. 8C is a diagrammatic view of a new keyway in accordance with the invention.
Figure 9B:
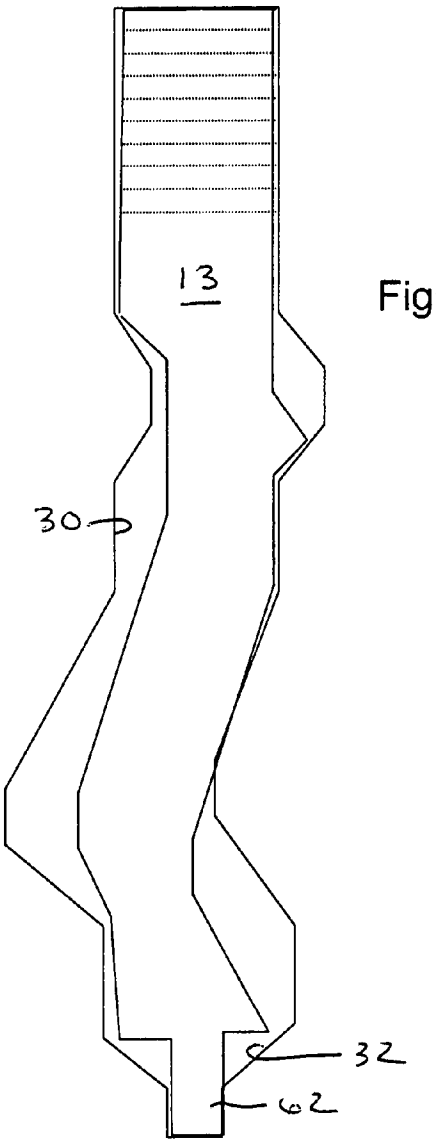
FIG. 9B is a diagrammatic view depicting the position of a new master key within a new keyway configured in accordance with the invention.
Figure 9A:
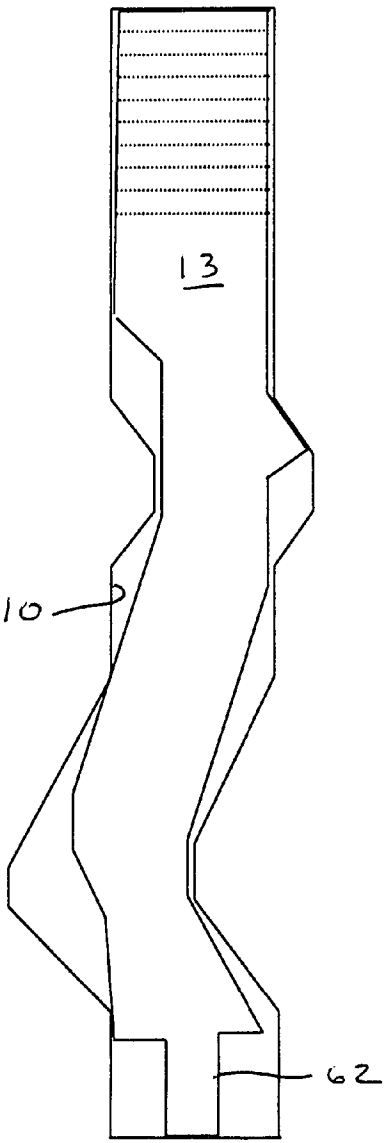
FIG. 9A is a diagrammatic view depicting the position of a new master key configured in accordance with the invention within an "old" keyway.

Depicted in FIGS. 8A to 8C, in conjunction with an "old" keyway 10 and a "new" keyway 30 of the present invention, is a master key 13 cut from a specially-configured key blank so that it can enter and operate locks using either of the keyways 10, 30. Master key 13 includes a projection 62 shaped and dimensioned for baseline receipt in the foot 32 of a keyway 30, as shown in FIG. 9B, so that master key 13 can enter a keyway 30 and operate a lock associated with the keyway. Master key 13 is further dimensioned and configured for baseline entry into an "old" keyway 10, as shown in FIG. 9A, to operate a lock associated with that keyway. In each case the lock pin stacks include separations or dislocations selectively located so that, when master key 13 is inserted into the respective keyway, the pin stacks are upwardly displaced to align those pin stack separations with the shear line and thereby enable operation of the lock by the master key.

Thus, the present invention contemplates the creation of a new key and corresponding keyway profile, both based on an existing or "old" key/keyway profile, to expand an existing simplex or multiplex lock and key system or hierarchy with one or more additional families of profiles with the expanded hierarchy sharing a master key for operating locks using any of the "old" or "new" keyways. Unlike prior art hierarchy expansion schemes in which the new keyway is configured to block the entry of pre-existing or "old" keys and to thereby increase the number of unique, available lock and key combinations in the hierarchy—i.e. so that the keys of one family are unable to enter the keyways of another family, such as the newly-added family with which the hierarchy has been expanded—in the present invention the "old" key is able to enter the "new" keyway, but is unable to operate the associated lock because the "old" key can only be positioned in the "new" keyway in a manner that elevates the key off or above the bottom or baseline 39 of the "new" keyway. The "old" key, positioned in the "new" keyway, accordingly lifts the pin stacks of the lock above the point at which the pin stack separations are aligned with the shear line, and cannot therefore operate the lock—even though the "old" key may be cut with the same bitting combination that will operate the lock when a "new" key cut with that bitting combination and having the proper profile for baseline receipt in the "new" keyway is advanced into the keyway.

While there have shown and described and pointed out fundamental novel features of the invention as applied to preferred embodiments thereof, it will be understood that various omissions and substitutions and changes in the form and details of the methods described and devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. In a lock-and-key system comprising a plurality of differently-bitted first keys each having a first profile and a corresponding plurality of first locks each operable by a corresponding one of said first keys and each having a first keyway configured to accept said first key profile for entry of said first keys into said first keyways, wherein said first key profile comprises a first key section that extends between a base having a width and a top bitting surface and a predetermined contour defined by a groove extending along said first key section at a predetermined spacing above said first key base, and wherein said first keyway has a profile complementary to said first key profile and comprises a blocking element disposed for complementary mating engagement with the first key groove when the first key is disposed in said first keyway, the improvement comprising a method of providing a plurality of second locks each having a second keyway and a plurality of differently-bitted second keys each having a second profile and each bitted for operating a corresponding one of said second locks, said second keyway being configured so that each of said first locks and each of said second locks can be entered through the respective first and second keyways by a single master key distinct from said first and second keys for operating all of said first and second locks, comprising the steps of:

configuring the second key profile as comprising a core section configured as said first key profile and a narrowed projection extending from said first key profile base of said core section in a direction away from the second key bitting surface and having a width less than said first key base width such that said second key cannot enter the first keyway of said first locks; and configuring the second keyway for receipt of said second key profile and including a foot for accommodating said second key projection and a blocking element for complementary mating engagement with a groove defined in said second key core section when the second key enters the second keyway and for complementary mating engagement with said first key groove when the first key enters the second keyway so that said first key is receivable in said second keyway;

wherein said first key profile has a height x defined between said first key base and said first key top surface, said second key profile has a height z defined between a bottom-most extension of said projection and an uncut top surface of said second key, and said second key projection has a height y defined between said bottom-most extension and said second key core section, wherein said second key profile height z comprises substantially a sum of the first key profile height x and the second key projection height y.

2. In a lock-and-key system comprising a plurality of differently-bitted first keys each having a first profile and a corresponding plurality of first locks each operable by a corresponding one of said first keys and each having a first keyway configured to accept said first key profile for entry of said first keys into said first keyways, wherein said first key profile comprises a first key section that extends between a base having a width and a top bitting surface and a predetermined contour defined by a groove extending along said first key section at a predetermined spacing above said first key base, and wherein said first keyway has a profile complementary to said first key profile and comprises a blocking element disposed for complementary mating engagement with the first key groove when the first key is disposed in said first keyway, the improvement comprising a method of providing a plurality of second locks each having a second keyway and a plurality of differently-bitted second keys each having a second profile and each bitted for operating a corresponding one of said second locks, said second keyway being configured so that each of said first locks and each of said second locks can be entered through the respective first and second keyways by a single master key distinct from said first and second keys for operating all of said first and second locks, comprising the steps of:

configuring the second key profile as comprising a core section configured as said first key profile and a narrowed projection extending from said first key profile base of said core section in a direction away from the second key bitting surface and having a width less than said first key base width such that said second key cannot enter the first keyway of said first locks; and configuring the second keyway for receipt of said second key profile and including a foot for accommodating said second key projection and a blocking element for complementary mating engagement with a groove defined in said second key core section when the second key enters the second keyway and for complementary mating engagement with said first key groove when the first key enters the second keyway so that said first key is receivable in said second keyway;

wherein said second keyway foot is configured to gradually narrow, from a top toward a bottom of said foot, from said first key base width such that the first key base is prevented from entering said foot when the first key enters said second keyway and thereby suitably position said first key profile within said second keyway profile for complementary mating engagement of said first key groove and said second keyway blocking element to enable receipt of said first key in said second keyway.

3. In a lock-and-key system comprising a plurality of differently-bitted first keys each having a first profile and a corresponding plurality of first locks each operable by a corresponding one of said first keys and each having a first keyway configured to accept said first key profile for entry of said first keys into said first keyways, wherein said first key profile comprises a first key section that extends between a base having a width and a top bitting surface and a predetermined contour defined by a groove extending along said first key section at a predetermined spacing above said first key base, and wherein said first keyway has a profile complementary to said first key profile and comprises a blocking element disposed for complementary mating engagement with the first key groove when the first key is disposed in said first keyway, the improvement comprising a method of providing a plurality of second locks each having a second keyway and a plurality of differently-bitted second keys each having a second profile and each bitted for operating a corresponding one of said second locks, said second keyway being configured so that each of said first locks and each of said second locks can be entered through the respective first and second keyways by a single master key distinct from said first and second keys for operating all of said first and second locks, comprising the steps of:

configuring the second key profile as comprising a core section configured as said first key profile and a narrowed projection extending from said first key profile base of said core section in a direction away from the second key bitting surface and having a width less than said first key base width such that said second key cannot enter the first keyway of said first locks; and configuring the second keyway for receipt of said second key profile and including a foot for accommodating said second key projection and a blocking element for complementary mating engagement with a groove defined in said second key core section when the second key enters the second keyway and for complementary mating engagement with said first key groove when the first key enters the second keyway so that said first key is receivable in said second keyway;

wherein said narrowed projection comprises a plurality of spaced apart projections, at least one of which has a substantially constant width, and wherein an end-to-end width of said plural projections is less than said first key base width.

4. In a lock-and-key system comprising a plurality of differently-bitted first keys each having a first profile and a corresponding plurality of first locks each operable by a corresponding one of said first keys and each having a first keyway configured to accept said first key profile for entry of said first keys into said first keyways, wherein said first key profile comprises a first key section that extends between a base having a width and a top bitting surface and a predetermined contour defined by a groove extending along said first key section at a predetermined spacing above said first key base, and wherein said first keyway has a profile complementary to said first key profile and comprises a blocking element disposed for complementary mating engagement with the first key groove when the first key is disposed in said first keyway, the improvement comprising a method of providing a plurality of second locks each having a second keyway and a plurality of differently-bitted second keys each having a second profile and each bitted for operating a corresponding one of said second locks, said second keyway being configured so that each of said first locks and each of said second locks can be entered through the respective first and second keyways by a single master key distinct from said first and second keys for operating all of said first and second locks, comprising the steps of:

configuring the second key profile as comprising a core section configured as said first key profile and a narrowed projection extending from said first key profile base of said core section in a direction away from the second key bitting surface and having a width less than said first key base width such that said second key cannot enter the first keyway of said first locks; and configuring the second keyway for receipt of said second key profile and including a foot for accommodating said second key projection and a blocking element for complementary mating engagement with a groove defined in said second key core section when the second key enters the second keyway and for complementary mating engagement with said first key groove when the first key enters the second keyway so that said first key is receivable in said second keyway;

wherein said narrowed projection comprises a projection having an angled face that defines a gradually narrowing width.

5. In a lock-and-key system comprising a plurality of differently-bitted first keys each having a first profile and a corresponding plurality of first locks each operable by a corresponding one of said first keys and each having a first keyway configured to accept said first key profile for entry of said first keys into said first keyways, wherein said first key profile comprises a first key section that extends between a base having a width and a top bitting surface and a predetermined contour defined by a groove extending along said first key section at a predetermined spacing above said first key base, and wherein said first keyway has a profile complementary to said first key profile and comprises a blocking element disposed for complementary mating engagement with the first key groove when the first key is disposed in said first keyway, the improvement comprising a method of providing a plurality of second locks each having a second keyway and a plurality of differently-bitted second keys each having a second profile and each bitted for operating a corresponding one of said second locks, said second keyway being configured so that each of said first locks and each of said second locks can be entered through the respective first and second keyways by a single master key distinct from said first and second keys for operating all of said first and second locks, comprising the steps of:

configuring the second key profile as comprising a core section configured as said first key profile and a narrowed projection extending from said first key profile base of said core section in a direction away from the second key bitting surface and having a width less than said first key base width such that said second key cannot enter the first keyway of said first locks; and configuring the second keyway for receipt of said second key profile and including a foot for accommodating said second key projection and a blocking element for complementary mating engagement with a groove defined in said second key core section when the second key enters the second keyway and for complementary mating engagement with said first key groove when the first key enters the second keyway so that said first key is receivable in said second keyway;

wherein said narrowed projection comprises a frustoconical portion that tapers to a substantially constant-width tongue extending from said frustoconical portion.

6. In a lock-and-key system comprising a plurality of differently-bitted first keys each having a first profile and a corresponding plurality of first locks each operable by a corresponding one of said first keys and each having a first keyway configured to accept said first key profile for entry of said first keys into said first keyways, wherein said first key profile comprises a first key section that extends between a base having a width and a top bitting surface and a predetermined contour defined by a groove extending along said first key section at a predetermined spacing above said first key base, and wherein said first keyway has a profile complementary to said first key profile and comprises a blocking element disposed for complementary mating engagement with the first key groove when the first key is disposed in said first keyway, the improvement comprising a method of providing a plurality of second locks each having a second keyway and a plurality of differently-bitted second keys each having a second profile and each bitted for operating a corresponding one of said second locks, said second keyway being configured so that each of said first locks and each of said second locks can be entered through the respective first and second keyways by a single master key distinct from said first and second keys for operating all of said first and second locks, comprising the steps of:

configuring the second key profile as comprising a core section configured as said first key profile and a narrowed projection extending from said first key profile base of said core section in a direction away from the second key bitting surface and having a width less than said first key base width such that said second key cannot enter the first keyway of said first locks; and configuring the second keyway for receipt of said second key profile and including a foot for accommodating said second key projection and a blocking element for complementary mating engagement with a groove defined in said second key core section when the second key enters the second keyway and for complementary mating engagement with said first key groove when the first key enters the second keyway so that said first key is receivable in said second keyway;

wherein said narrowed projection comprises a frustoconical portion and a substantially constant-width portion.

7. In a lock-and-key system that includes a first lock-and-key family comprising a plurality of differently-bitted first keys each having a first profile and a corresponding plurality of first locks each operable by a corresponding one of said first keys and each having a first keyway configured to accept said first key profile for entry of said first keys into said first keyways, wherein said first key profile comprises a first key section that extends between a base having a width and a top bitting surface and a predetermined contour defined by a groove extending along said first key section at a predetermined spacing above said first key base, and wherein said first keyway has a profile complementary to said first key profile and comprises a blocking element disposed for complementary mating engagement with the first key groove when the first key is disposed in said first keyway, the improvement comprising a second lock-and-key family, said second family comprising:

a plurality of second locks each having a second keyway; and a plurality of differently-bitted second keys each having a second profile and each bitted for operating a corresponding one of said second locks;

wherein said second keyway is configured so that each of said first locks and each of said second locks can be entered through the respective first and second keyways by a single master key for operating all of said first and second locks;

wherein said second key profile comprises a core section configured as said first key profile and a narrowed projection extending from said first key profile base of said core section in a direction away from the second key bitting surface and having a width less than said first key base width such that said second key cannot enter the first keyway of said first locks; and wherein said second keyway is configured for receipt of said second key profile and includes a foot for accommodating said second key projection and a blocking element for complementary mating engagement with a groove defined in said second key core section when the second key enters the second keyway and for complementary mating engagement with said first key groove when the first key enters the second keyway so that said first key is receivable in said second keyway;

wherein said first key profile has a height x defined between said first key base and said first key top surface, said second key profile has a height z defined between a bottom-most extension of said projection and an uncut top surface of said second key, and said second key projection has a height y defined between said bottom-most extension and said second key core section, wherein said second key profile height z comprises substantially a sum of the first key profile height x and the second key projection height y.

8. In a lock-and-key system that includes a first lock-and-key family comprising a plurality of differently-bitted first keys each having a first profile and a corresponding plurality of first locks each operable by a corresponding one of said first keys and each having a first keyway configured to accept said first key profile for entry of said first keys into said first keyways, wherein said first key profile comprises a first key section that extends between a base having a width and a top bitting surface and a predetermined contour defined by a groove extending along said first key section at a predetermined spacing above said first key base, and wherein said first keyway has a profile complementary to said first key profile and comprises a blocking element disposed for complementary mating engagement with the first key groove when the first key is disposed in said first keyway, the improvement comprising a second lock-and-key family, said second family comprising:

a plurality of second locks each having a second keyway; and a plurality of differently-bitted second keys each having a second profile and each bitted for operating a corresponding one of said second locks;

wherein said second keyway is configured so that each of said first locks and each of said second locks can be entered through the respective first and second keyways by a single master key for operating all of said first and second locks;

wherein said second key profile comprises a core section configured as said first key profile and a narrowed projection extending from said first key profile base of said core section in a direction away from the second key bitting surface and having a width less than said first key base width such that said second key cannot enter the first keyway of said first locks; and wherein said second keyway is configured for receipt of said second key profile and includes a foot for accommodating said second key projection and a blocking element for complementary mating engagement with a groove defined in said second key core section when the second key enters the second keyway and for complementary mating engagement with said first key groove when the first key enters the second keyway so that said first key is receivable in said second keyway;

wherein said second keyway foot is configured to gradually narrow, from a top toward a bottom of said foot, from said first key base width such that the first key base is prevented from entering said foot when the first key enters said second keyway and thereby suitably position said first key profile within said second keyway profile for complementary mating engagement of said first key groove and said second keyway blocking element to enable receipt of said first key in said second keyway.

9. In a lock-and-key system that includes a first lock-and-key family comprising a plurality of differently-bitted first keys each having a first profile and a corresponding plurality of first locks each operable by a corresponding one of said first keys and each having a first keyway configured to accept said first key profile for entry of said first keys into said first keyways, wherein said first key profile comprises a first key section that extends between a base having a width and a top bitting surface and a predetermined contour defined by a groove extending along said first key section at a predetermined spacing above said first key base, and wherein said first keyway has a profile complementary to said first key profile and comprises a blocking element disposed for complementary mating engagement with the first key groove when the first key is disposed in said first keyway, the improvement comprising a second lock-and-key family, said second family comprising:

a plurality of second locks each having a second keyway; and a plurality of differently-bitted second keys each having a second profile and each bitted for operating a corresponding one of said second locks;

wherein said second keyway is configured so that each of said first locks and each of said second locks can be entered through the respective first and second keyways by a single master key for operating all of said first and second locks;

wherein said second key profile comprises a core section configured as said first key profile and a narrowed projection extending from said first key profile base of said core section in a direction away from the second key bitting surface and having a width less than said first key base width such that said second key cannot enter the first keyway of said first locks; and wherein said second keyway is configured for receipt of said second key profile and includes a foot for accommodating said second key projection and a blocking element for complementary mating engagement with a groove defined in said second key core section when the second key enters the second keyway and for complementary mating engagement with said first key groove when the first key enters the second keyway so that said first key is receivable in said second keyway;

wherein said narrowed projection comprises a plurality of spaced apart projections, at least one of which has a substantially constant width, and wherein an end-to-end width of said plural projections is less than said first key base width.

10. In a lock-and-key system that includes a first lock-and-key family comprising a plurality of differently-bitted first keys each having a first profile and a corresponding plurality of first locks each operable by a corresponding one of said first keys and each having a first keyway configured to accept said first key profile for entry of said first keys into said first keyways, wherein said first key profile comprises a first key section that extends between a base having a width and a top bitting surface and a predetermined contour defined by a groove extending along said first key section at a predetermined spacing above said first key base, and wherein said first keyway has a profile complementary to said first key profile and comprises a blocking element disposed for complementary mating engagement with the first key groove when the first key is disposed in said first keyway, the improvement comprising a second lock-and-key family, said second family comprising:

a plurality of second locks each having a second keyway; and a plurality of differently-bitted second keys each having a second profile and each bitted for operating a corresponding one of said second locks;

wherein said second keyway is configured so that each of said first locks and each of said second locks can be entered through the respective first and second keyways by a single master key for operating all of said first and second locks;

wherein said second key profile comprises a core section configured as said first key profile and a narrowed projection extending from said first key profile base of said core section in a direction away from the second key bitting surface and having a width less than said first key base width such that said second key cannot enter the first keyway of said first locks; and wherein said second keyway is configured for receipt of said second key profile and includes a foot for accommodating said second key projection and a blocking element for complementary mating engagement with a groove defined in said second key core section when the second key enters the second keyway and for complementary mating engagement with said first key groove when the first key enters the second keyway so that said first key is receivable in said second keyway;

wherein said narrowed projection comprises a projection having an angled face that defines a gradually narrowing width.

11. In a lock-and-key system that includes a first lock-and-key family comprising a plurality of differently-bitted first keys each having a first profile and a corresponding plurality of first locks each operable by a corresponding one of said first keys and each having a first keyway configured to accept said first key profile for entry of said first keys into said first keyways, wherein said first key profile comprises a first key section that extends between a base having a width and a top bitting surface and a predetermined contour defined by a groove extending along said first key section at a predetermined spacing above said first key base, and wherein said first keyway has a profile complementary to said first key profile and comprises a blocking element disposed for complementary mating engagement with the first key groove when the first key is disposed in said first keyway, the improvement comprising a second lock-and-key family, said second family comprising:

a plurality of second locks each having a second keyway; and a plurality of differently-bitted second keys each having a second profile and each bitted for operating a corresponding one of said second locks;

wherein said second keyway is configured so that each of said first locks and each of said second locks can be entered through the respective first and second keyways by a single master key for operating all of said first and second locks;

wherein said second key profile comprises a core section configured as said first key profile and a narrowed projection extending from said first key profile base of said core section in a direction away from the second key bitting surface and having a width less than said first key base width such that said second key cannot enter the first keyway of said first locks; and wherein said second keyway is configured for receipt of said second key profile and includes a foot for accommodating said second key projection and a blocking element for complementary mating engagement with a groove defined in said second key core section when the second key enters the second keyway and for complementary mating engagement with said first key groove when the first key enters the second keyway so that said first key is receivable in said second keyway;

wherein said narrowed projection comprises a frustoconical portion that tapers to a substantially constant-width tongue extending from said frustoconical portion.

12. In a lock-and-key system that includes a first lock-and-key family comprising a plurality of differently-bitted first keys each having a first profile and a corresponding plurality of first locks each operable by a corresponding one of said first keys and each having a first keyway configured to accept said first key profile for entry of said first keys into said first keyways, wherein said first key profile comprises a first key section that extends between a base having a width and a top bitting surface and a predetermined contour defined by a groove extending along said first key section at a predetermined spacing above said first key base, and wherein said first keyway has a profile complementary to said first key profile and comprises a blocking element disposed for complementary mating engagement with the first key groove when the first key is disposed in said first keyway, the improvement comprising a second lock-and-key family, said second family comprising:

a plurality of second locks each having a second keyway; and a plurality of differently-bitted second keys each having a second profile and each bitted for operating a corresponding one of said second locks;

wherein said second keyway is configured so that each of said first locks and each of said second locks can be entered through the respective first and second keyways by a single master key for operating all of said first and second locks;

wherein said second key profile comprises a core section configured as said first key profile and a narrowed projection extending from said first key profile base of said core section in a direction away from the second key bitting surface and having a width less than said first key base width such that said second key cannot enter the first keyway of said first locks; and wherein said second keyway is configured for receipt of said second key profile and includes a foot for accommodating said second key projection and a blocking element for complementary mating engagement with a groove defined in said second key core section when the second key enters the second keyway and for complementary mating engagement with said first key groove when the first key enters the second keyway so that said first key is receivable in said second keyway;

wherein said narrowed projection comprises a frustoconical portion and a substantially constant-width portion.

13. In a lock-and-key system comprising a plurality of differently-bitted first keys each having a first profile and a corresponding plurality of first locks each operable by a corresponding one of said first keys and each having a first keyway configured to accept said first key profile for entry of said first keys into said first keyways, wherein said first key profile comprises a first key section that extends between a base having a width and a top bitting surface and a predetermined contour defined by a groove extending along said first key section at a predetermined spacing above said first key base, and wherein said first keyway has a profile complementary to said first key profile and comprises a blocking element disposed for complementary mating engagement with the first key groove when the first key is disposed in said first keyway, the improvement comprising a method of providing a plurality of second locks each having a second keyway for use with a plurality of differently-bitted second keys each having a second profile complimentary to a profile of the second keyway and each bitted for operating a corresponding one of said second locks, said second keyway being configured so that each of said first locks and each of said second locks can be entered through the respective first and second keyways by a single master key distinct from said first and second keys for operating all of said first and second locks, said method comprising configuring the second profile of the second keyway as comprising a core section configured complimentary to said first key profile and a narrowed foot recess extending from said core section in a direction away from said core section to a baseline of the second keyway, said narrowed foot having a width less than said first key base width, for receipt by said second keyway of the complimentary second key profile and for receipt by said second keyway of the first key in a position in which the first key enters the complimentary core section of the second keyway and is unable to enter the narrowed foot of the second keyway and is thereby elevated in the second keyway above the second keyway baseline to prevent operation of the second lock by the first key;

wherein said second keyway foot is configured to gradually narrow, from a top toward a bottom of said foot at said second keyway baseline, from said first key base width such that the first key base is prevented from entering said foot when the first key enters said second keyway.

* * * * *